United States Patent [19]

Leuenberger

[11] Patent Number: 4,756,481

[45] Date of Patent: Jul. 12, 1988

[54] APPARATUS FOR SPRAYING A FLOWABLE MASS AND INCLUDING AN AIRLESS SPRAY GUN

[75] Inventor: Hans Leuenberger, Bottighofen, Switzerland

[73] Assignee: Theo Krebs AG, Kreuzlingen, Switzerland

[21] Appl. No.: 933,976

[22] Filed: Nov. 24, 1986

[51] Int. Cl.[4] ..... B05B 9/04

[52] U.S. Cl. ..... 239/332; 239/373; 222/255

[58] Field of Search ..... 239/346, 355, 360, 373, 239/332, 329; 222/255, 263, 258, 262, 333

[56] References Cited

U.S. PATENT DOCUMENTS

| | | | |
|---|---|---|---|
| 3,023,969 | 3/1962 | Hudson et al. | 239/360 |
| 4,109,831 | 8/1978 | Culpepper et al. | 222/263 |
| 4,160,525 | 7/1979 | Wagner | 239/332 |

FOREIGN PATENT DOCUMENTS

| | | | |
|---|---|---|---|
| 2223578 | 11/1973 | Fed. Rep. of Germany | 239/332 |
| 945315 | 12/1963 | United Kingdom | 239/360 |

*Primary Examiner*—Andres Kashnikow
*Assistant Examiner*—Karen B. Merritt
*Attorney, Agent, or Firm*—Diller, Ramik & Wight

[57] ABSTRACT

The mass to be sprayed by the spray gun is stored in an airtight closed storage container. A cushion of pressurized air is generated above the level of the paint mass present in the storage container. This air cushion is fed by means of a manually operated piston pump projecting into the storage container. Accordingly, the mass to be sprayed and fed via the feed line extending to the spray gun is pressurized. Conclusively the feed line can be designed with a longer dimension, the mass to be sprayed can be more viscous and the distance in height between storage container and spray gun can be much larger.

7 Claims, 1 Drawing Sheet

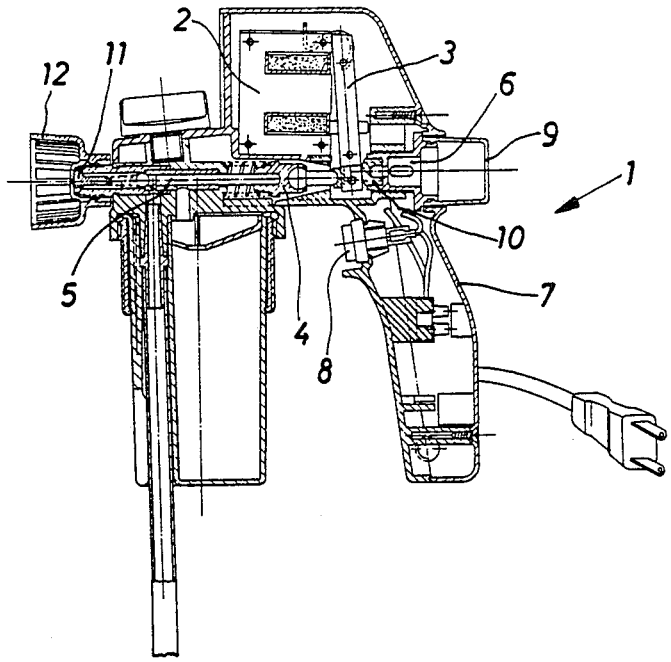
2
3
12
11
6
9
1
10
5
7
4
8
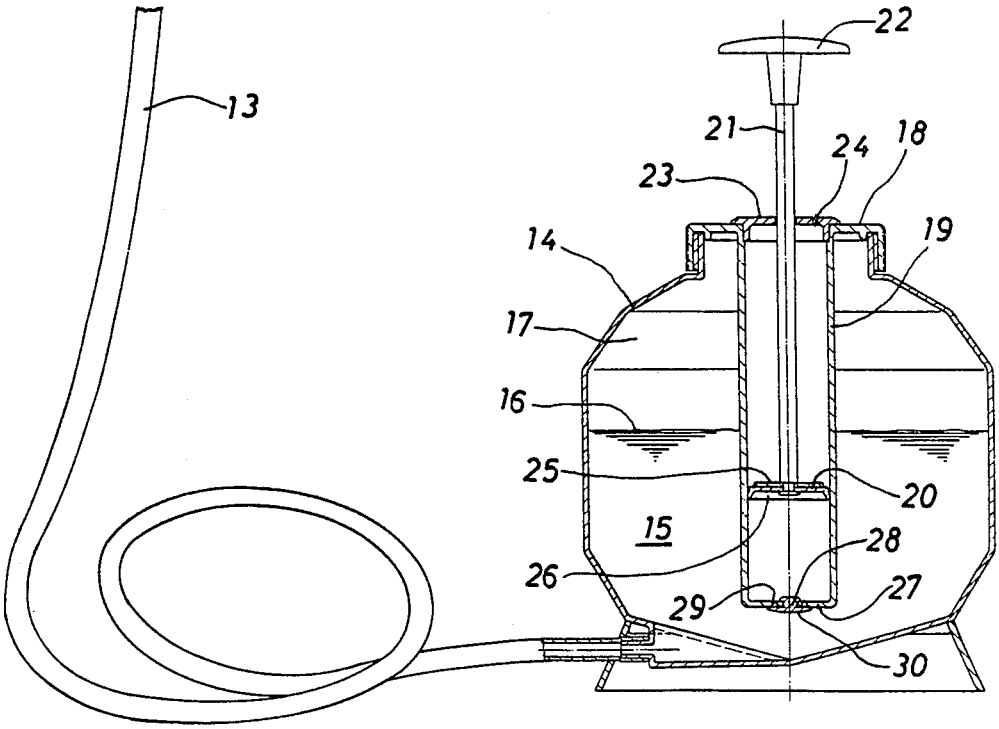
22
13
21
24
18
23
19
14
17
16
25
20
15
28
26
27
29
30

APPARATUS FOR SPRAYING A FLOWABLE MASS AND INCLUDING AN AIRLESS SPRAY GUN

BACKGROUND OF THE INVENTION

1. Field of the Invention

The present invention relates to an apparatus for spraying a flowable mass and including an airless spray gun.

Such mass may be paint, lacquer etc. used for applying onto and covering a surface. Airless spray guns are characterized in that the mass being sprayed is not transported by means of pressurized air but rather by an electrically driven fluid pump.

2. Description of the Prior Art

With regard to the known storage containers for the mass to be sprayed in connection with the presently known spray guns it is possible to differentiate between two designs. The first design incorporates a storage container which is directly mounted to the spray gun by means of e.g. a screw tight connection. The other design incorporates a feed line coupled to the spray gun whereby the opposite end of such feed line is immersed into the original mass storage barrel such that the flowable mass is sucked by the spray gun via mentioned feed line out of the barrel.

Because now the flowable mass such as e.g. in case of the known latex paints is subject to a frictional resistance within the feed line or aspirating line, respectively, it is not possible to use together with manually carried spray guns a feed line having a length over 6 feet (2 meters). Accordingly, the storage container must in use be carried along by the painter because the distance between the spray gun and the storage container cannot exceed 6 feet (2 meters).

SUMMARY OF THE INVENTION

Hence, it is a general object of the invention to provide an apparatus for spraying a flowable mass and including an airless spray gun, in which the length of the feed line extending between the spray gun and the paint storage container can be chosen arbitrarily.

A further object of the present invention is to provide an airless spray gun having a means for pumping the flowable mass and comprising a feed line mounted by one of its ends to the airless spray gun, through which feed line the flowable mass to be conveyed by the pumping means of the airless spray gun is led towards the spray gun, which feed line is coupled at its opposite end to an airtight sealed storage container in which the flowable mass is stored, and comprising further a means for pressurizing the volume of the flowable mass present in the supply line at the location of the opposite end thereof.

By means of the inventive apparatus the frictional resistance which a latex paint is subjected to in the feed line can be overcome such that the feed line can be arbitrarily long. Furthermore, the airless spray gun can aspirate or suck, respectively, and spray substantially more viscous mediums or fluids, respectively, than it has been hitherto possible such that it is possible to produce a much better covering of a surface to be painted than it has been at all possible until now. Furthermore, the duration of the start-up of the operation of the spray gun can be cut to be much shorter, which leads to a shorter duration of the dry operation of the pump and correspondingly the pump piston and pump cylinder are subjected to much less wear.

It is now no longer necessary that the paint storage container must be carried along by the painter as soon as he changes his position and it also is no longer necessary for the painter to place the storage container in case of painting a ceiling on an elevated often only makeshift stand or scaffolding. Last not least, it must be noted that now the paint storage container is a completely closed bin. Until now, these containers had to be open to allow the operation of the spray guns as such. Because now the container is completely closed, it is no longer possible that a foreign body can drop into the stored mass, that the paint will flow out of the container when the latter is tipped over or overturned or even that the painter himself will inadvertently step into the container and thus into the paint mass stored therein.

BRIEF DESCRIPTION OF THE DRAWING

The invention will be better understood and objects other than those set forth above will become apparent when consideration is given to the following detailed description thereof. Such description makes reference to the annexed drawing, wherein:

The single figure illustrates a sectional view of a preferred embodiment of the invention.

DESCRIPTION OF THE PREFERRED EMBODIMENT

An airless spray gun is generally identified by the reference numeral 1. Such spray guns are characterized in that they convey and transport a mass to be sprayed directly by means of a piston pump.

The spray gun comprises an oscillating armature 2, in which the armature is identified by reference numeral 3. This armature 3 acts via transmission members or links 4, respectively, onto a pump piston 5. The stroke of the pump piston 5 is set and adjusted by means of an adjusting device 6.

This adjusting device 6 includes a rotary knob 9 having an abutment stop 10 provided with an outer thread end limiting the stroke of the pump piston 5. The push button 8 for starting and operating the spray gun is located in the handhold 7. The safety cage 12 of known design extends around the spray nozzle 11.

A feed line 13 extends from the spray gun 1 to an airtight closed storage container 14, in which the mass 15 to be sprayed, for instance, paint, varnish, lacquer etc., is stored. This mass 15 does however not fill the inner space of the storage container 14 completely. An airspace 17 is provided above the surface 16 of the mass 15. The storage container 14 is airtight shut by means of a lid 18. This lid 18 is made integrally with a cylinder 19 and a piston 20 is arranged longitudinally displaceable within the cylinder 19. Piston 20 is coupled via a piston rod 21 to a pumping handle 22. The piston rod 21 extends in an airtightly sealed manner through a lid insert 23, which is provided with at least one air aspiration through hole 24. The piston 20 is composed of a rigid plate 25 which is rigidly mounted to the piston rod 21 and of a sealing dish 26 made of an elastic material. The circumferential edge of the sealing disk 26 abuts the inner wall of the cylinder 19 in a lip-seal like fashion. A check valve 28 made of an elastic material is inserted in the bottom face wall 27 of the cylinder 19. This face wall 27 has, furthermore, perforations 29 which are closed off by the shutoff disk 30 of the check valve 28 when the latter is in its rest position.

In operation a downwards stroke of piston 20 results in a conveying of air located in the cylinder section below the piston 20 through the perforations 29 and the elastically yielding shutoff disk 30 into the inner space of the container and the airspace 17 and simultaneously air is aspirated through the air aspiration hole in the lid insert 23.

During an upwards stroke of the piston 20 the shutoff disk 30 overlies sealingly the perforations 29 and the air present in the cylinder section above piston 20 can flow via the yielding lid seal of the sealing disk 26 in a pressure equalizing manner into the lower cylinder section. The diameter of the air aspiration hole 24 is given such a small dimension that only little air can escape during the upwards stroke of the piston 5. If necessary, a check valve can also be located in the air aspiration hole 24, such check valve being designed similarly to valve 28.

By means of the pumping action of piston 20 air is transported and conveyed into the pressurized air space 17 of the storage container 14 such that an air cushion is generated over the surface 16 of the mass 15 stored in the container and intended to be sprayed by the airless spray gun. Accordingly, the mass to be sprayed is now pressurized. Conclusively, the net suction height for the pump piston 5 of the spray gun 1 is much lower in comparison with a sucking of the mass to be sprayed from and out of an opened container or barrel, respectively, in which merely atmospheric pressure acts onto the surface of the mass stored therein. The feed line 13 can be several times longer than has been possible until now, the mass to be sprayed can be much more viscous and the difference in height between the location of the spray gun 1 and the location of the storage container 14 can be maintained much higher than has been hitherto possible.

While there is shown and described the present preferred embodiment of the invention, it is to be distinctly understood that the invention is not limited thereto, but may be otherwise variously embodied and practiced within the scope of the following claims.

I claim:

1. Apparatus for spraying a liquid fluid in atomized form comprising an airless spray gun, a relatively long feed line, and an air-tight sealed storaged container; said feed line having opposite first and second ends connected respectively to said airless spray gun and said storage container whereby the airless spray gun and storage container are in fluid communication, a volume of liquid fluid in said storage container and in said feed line, means at the location of said second end for pressurizing the volume of liquid fluid in said storage container and feed line whereby pressurized liquid fluid is delivered through said feed line first end to said airless spray gun, said airless spray gun having means for atomizing luquid fluid, and said airless spray gun further including means for pumping the pressurized liquid fluid to said atomizing means whereby the pressurized liquid fluid is sprayed in atomized form.

2. The apparatus as defined in claim 1 wherein said pressurizing means includes second pumping means for pumping the pressurized liquid fluid from said storage container to said spray gun.

3. The apparatus as defined to claim 1 wherein said pressurizing means includes second pumping means for pumping the pressurized liquid fluid from said storage container to said spary gun, and said second pumping means is located in said storage container.

4. The apparatus as defined in claim 1 wherein said pressurizing means includes means for generating an air cushion above an upper surface level of the liquid fluid within said storage container.

5. The apparatus as defined in claim 1 wherein said pressurizing means includes air compressing means for generating an air cushion above an upper surface level of the liquid fluid within said storage container.

6. The apparatus as defined in claim 1 wherein said pressurizing means includes manually operable air pump means for generating an air cushion above an upper surface level of the liquid fluid within said storage container.

7. The apparatus as defined in claim 1 wherein said pressurizing means includes manually operable air pump means for generating an air cushion above an upper surface level of the liquid fluid within said storage container, and check valve means for effecting the introduction of air into and preventing the exit of air out of said storage container during the operation of said air pump means.

* * * * *